US006231250B1

(12) United States Patent
Tobita et al.

(10) Patent No.: US 6,231,250 B1
(45) Date of Patent: May 15, 2001

(54) METHOD OF CONTROLLING RECIPROCAL MOVEMENT OF HAMMER RANK IN PRINT DEVICE

(75) Inventors: Satoru Tobita; Yoshikane Matsumoto; Hideaki Mamiya; Yuji Ohmura, all of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/204,367

(22) Filed: Dec. 4, 1998

(30) Foreign Application Priority Data

Dec. 5, 1997 (JP) ..... 9-335563

(51) Int. Cl.[7] ..... B41J 21/16
(52) U.S. Cl. ..... 400/279; 400/283
(58) Field of Search ..... 400/279, 283

(56) References Cited

U.S. PATENT DOCUMENTS 3,854,566 12/1974 Ellis .

*Primary Examiner*—John S. Hilten
*Assistant Examiner*—Charles H. Nolan, Jr.
(74) *Attorney, Agent, or Firm*—McGuireWoods LLP

(57) ABSTRACT

A hammer bank mounted on direct drive bearings reciprocally moves along a shaft. Springs provided at each end of the shaft supplies repulsive force to the hammer bank. When sheet feed operations for a plurality of carriage returns are performed, the hammer bank is stopped at a predetermined position away from the springs. When the reciprocal movement of the hammer bank is restarted, the hammer bank is first moved to a reverse position where the repulsive force of the spring is in the maximum. Then, the hammer bank is accelerated by utilizing the repulsive force of the spring and restarts the reciprocal movement.

18 Claims, 13 Drawing Sheets

1000: NORMAL-IMAGE REGION
2000: OCR-IMAGE REGION
3000: BARCORD-IMAGE REGION
5000: RECORDING SHEET

METHOD OF CONTROLLING RECIPROCAL MOVEMENT OF HAMMER RANK IN PRINT DEVICE

BACKGROUND OF THE INVENTION

1. Field of the Invention

The present invention relates to a print device wherein a hammer bank forms an image on a recording medium while reciprocally transported by a shuttle mechanism. The present invention more particularly relates to such a print device including a reversing urging means for reversing a transporting direction of the hammer bank and to a method of controlling reciprocal movement of the hammer bank.

2. Description of Related Art

There has been known a print device including a hammer bank for forming an image on a recording medium, such as a sheet of paper, while reciprocally transported. Dot line printers and shuttle printers are representative examples of such print devices. Several types of shuttle mechanisms are known for reciprocally transporting the hammer bank. For example, one type of mechanism is provided with a cam or a link mechanism for converting rotational drive of a drive motor into a linear movement. Another type of mechanism reverses a transport direction of the hammer bank by changing rotational direction of a drive motor. There is also known a direct drive type mechanism including a linear motor. The direct drive type mechanism requires no transmission mechanism for transmitting drive of the linear motor to the hammer bank.

In order to provide a print unit wherein printing is performed in a improved speed, there has been proposed a shuttle mechanism provided with urging means, such as a spring. The urging means facilitates acceleration of transport speed of the hammer bank when its transport direction is reversed.

FIG. 1 shows an example of printing unit of a print device. The print unit includes such a shuttle mechanism provided with springs. Specifically, as shown in FIG. 1, the printing unit 1 includes a shuttle mechanism 2, a hammer bank 3, a sensor 4, and a shuttle drive mechanism. The shuttle mechanism 2 includes a guide shaft 11, direct drive bearings 12, a linear motor 20, an inversion mechanism 30, and springs 40. The shuttle drive mechanism includes a controller 50, a shuttle control circuit 60, and a shuttle drive circuit 70. The guide shaft 11 extends leftward and rightward as viewed in FIG. 1. The direct drive bearings 12 are reciprocally movably mounted on the guide shaft 11. The hammer bank 3 is supported on the direct drive bearings 12, and so reciprocally movable with the direct drive bearings 12. Although not shown in the drawings, the hammer bank 3 is provided with a plurality of printing hammers for forming a dot pattern on a recording medium based on print data received from an external device. The linear motor 20 is provided with a coil 21 and magnets (not shown), and driven in a well known manner. Although not shown in the drawings, the coil 21 includes a reverse coil and a constant velocity coil. The inversion mechanism 30 has a pair of timing pulleys 32 and a timing belt 31 wound around the timing pulleys 32. The coil 21 is connected to the direct drive bearings 12 via the inversion mechanism 30. With this configuration, the drive force of the linear motor 20 is transmitted to the direct drive bearings 12 so as to reciprocally transport the direct drive bearings 12. The coil 21 is also reciprocally transported in synchronization with the direct drive bearings 12, but always in a direction opposite to the direction in which the direct drive bearings 12 are transported. In this way, the coil

21 serves as a counter balance. That is, when the direct drive bearings 12 with the hammer bank 3 mounted thereon are reciprocally transported, such a reciprocal movement of the coil 21, which has a fixed weight, achieves leftward and rightward weight balance of the print device, thereby reducing vibration generated on the print device due to the transport of the direct drive bearings 12.

As shown in FIG. 1, the springs 40 are disposed at each end of the guide shaft 11 and the coil 21 for supplying repulsive force to the hammer bank 3, via the direct drive bearings 12, and the coil 21 when their transport directions are changed during reciprocal transport. The sensor 4 is provided near a movable portion, which in the present example is on the hammer bank side, for detecting a position of the hammer bank 3. The shuttle drive circuit 70 energizes the coil 21 by supplying an electric current, and the shuttle control circuit 60 controls the amount of electric current supplied to the coil 21. Based on positional information supplied by detection by the sensor 4, the controller 50 controls the shuttle control circuit 60 and the shuttle drive circuit 70 to move the hammer bank 3 in a predetermined shuttle speed pattern which is graphically shown in FIG. 3. The controller 50 also receives a variety of commands from an external device (not shown).

FIG. 2 shows a sheet transport mechanism 80. A platen 81 is rotatably supported on a printer frame (now shown). A pair of left and right pin tractors 82 are provided for transporting a sheet S on the platen 81 in a direction perpendicular to the reciprocal movement direction of the hammer bank 3. The platen 81 and the pin tractor 82 are driven by a sheet feed motor 83. An ink ribbon 84 is provided for supplying ink.

As shown in FIGS. 3 and 4, the hammer bank 3 is reciprocally moved in a transport region defined by a pair of predetermined reversing positions P0. The transport region is divided into a constant velocity region and two reverse regions. The constant velocity coil and the reverse coil are energized in the constant velocity region and in the reverse regions, respectively. In the constant velocity region, the hammer bank 3 is transported at a constant speed. On the other hand, in the reverse regions, the hammer bank 3 abuts against the spring 40 and influenced by the repulsive force of the spring 40. That is, in the reverse regions, the repulsive force is generated, and deceleration and acceleration of the shuttle are performed.

More specifically, when the hammer bank 3 enters the reverse region from the constant velocity region, the hammer bank 3 is decelerated by pressing against the spring 40. Then, the velocity of the hammer bank 3 drops to zero at the reverse point P0 wherein the spring 40 is maximally compressed. At this point, the repulsive force of the spring 40 increases to its maximum, and the transport direction of the hammer bank 3 is reversed. Next, the repulsive force of the spring 40 starts accelerating the hammer bank 3 in the reverse direction.

In the above-described print unit 1, there is a need to perform initialization operations when the print unit 1 is first started. The initialization operations mean repeating reciprocal transport, that is, shuttle operations, of the hammer bank 3 not associative with printing operations until a predetermined shuttle speed is achieved. More specifically, when the printing unit 1 is driven, the shuttle operations are started. However, the predetermined shuttle speed cannot be reached immediately. Therefore, the shuttle speed is gradually increased by repeating shuttle operations using the repulsive force of the spring 40. As the hammer bank 3 accelerates, the amount that the hammer bank 3 compresses the spring 40 increases. Printing is started once the hammer bank 3 compresses the spring 40 by a predetermined amount and the shuttle speed reaches a predetermined shuttle speed.

The initialization operations are also performed when shuttle operations are restarted after shuttle operations are temporarily stopped during printing.

As shown in FIG. 4, the shuttle operations during printing are repeated at a substantially fixed cycle. Normally, sheet feed operations are performed while the hammer bank 3 is in one of the reverse regions. That is, after a single row's worth of printing is completed at a position P1, sheet feed operations are performed for a single line's distance and completed by the time the shuttle reaches a print start position P2. Herein after, sheet feed operations for transporting the sheet a single line's distance will be alternatively referred to as a carriage return. Then, printing for a subsequent row is started. However, printing operations do not exclusively involve printing single lines separated by a single carriage return. Sometimes, sheet feed operations are required for a consecutive plurality of carriage returns. In this case, the amount of the sheet that must be fed at one time is greater than that during a single carriage return. Therefore, sheet feed for a plurality of carriage returns requires a greater amount of time than for a single carriage return. This relationship can be expressed by the following formula:

$$Tf<Tfn$$

wherein, Tf is the time duration required for a single carriage return; and

Tfn is the time duration required for a plurality of carriage returns (n is an integer equal to two or more).

For this reason, sheet feed operations for a plurality of carriage returns may not be completed while the hammer bank 3 is in a reverse region, that is, while the hammer bank 3 is between the position P1 and the print start position P2. Therefore, after the printing for one row's worth of images is completed at the position P1, it is desirable to stop the hammer bank 3 at the print start position P2 and restart the shuttle operation in synchronization with completion of the sheet feed operations. However, in this case, the hammer bank 3 cannot be accelerated to shuttle speed and cannot reach the predetermined shuttle speed immediately after the shuttle operations are restarted, because once the shuttle is stopped at the position P1, the repulsive force of the spring 40 cannot be utilized to accelerate the hammer bank 3. In order to utilize the repulsive force of the spring 40, the hammer bank 3 should be located at the reverse position P0. Accordingly, the initialization operations must be again performed, and printing for a subsequent row cannot be performed immediately.

In order to overcome these problems, when the plurality of carriage returns are not completed by the time the shuttle passes the print start position P2, the shuttle operations are continuously performed. Then, printing of the subsequent row is started at a next available print start position, for example, at a print start position P3, instead of at the print start position P2. That is, printing is not performed during printing region Tn. Therefore, wasted time is generated and printing efficiency is decreased.

For example, when Tfn is the time required to feed a sheet a plurality of lines (carriage returns) distance and Tp is the time duration required for one way transport of the hammer bank 3, and if the following relationship is established:

$$Tf<Tfn<(Tf+Tp),$$

the wasted time Tw is calculated by the following formula:

$$Tw=(Tf\times n+Tp)-Tfn$$

In other words, the amount of wasted time increases proportionally to the number of plural carriage returns performed during printing operations. As a result, operation efficiency is reduced.

Further, there have been known printers including a plurality of different printing modes relating to different shuttle speed patterns. However, in order to change the shuttle speed patterns during printing operations, the shuttle operations must be temporarily stopped. Therefore, in the conventional configuration described above, it is difficult to quickly change the shuttle speed pattern during printing operations.

SUMMARY OF THE INVENTION

It is an objective of the present invention to improve printing efficiency of a shuttle mechanism including a reverse urging mechanism to enable instantaneous starting and stopping of reciprocal movement of a hammer bank during printing operations that includes a plurality of carriage returns.

It is another objective of the present invention to enable rapid changing speed patterns during series of consecutive printing operations.

In order to achieve the above and the other objectives, there is provided a control method of controlling an image forming device. The image forming device includes a shaft extending, image forming unit, urging means, and a drive mechanism. The shaft extends in a longitudinal direction. The image forming unit is reciprocally movable along the shaft within a moving region defined by two extremes where the image forming unit reverses. The moving region includes first region, a second region, and a third region between the first region and the second region. The driving mechanism reciprocally moves the image forming unit. The urging means is provided in each of the first region and the second region for urging the image forming unit toward a center of the shaft when the image forming unit is in the first region or the second region. The image forming unit is brought into contact with the urging means when moved into the first region or the second region from the third region. The control method includes the steps of a) stopping the image forming unit at a predetermined position within the third region; and b) resume starting reciprocal movement of the image forming unit by moving the image forming unit to one of the two extremes whichever is closer to the predetermined position.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

A method according to a preferred embodiment of the present invention for controlling reciprocal movement of a hammer bank will be described while referring to the accompanying drawings.

A print unit in which the method of the present invention is applied is substantially the same as the conventional print unit 1 described above except that a shuttle drive circuit 70' and a controller 50' are provided in place of the shuttle drive circuit 70 and the controller 50. Description of common configuration of the print unit will be omitted to avoid duplication of explanation.

According to the present invention, stop and restart of shuttle operations are performed as when a plurality of carriage returns, mode switching operations, or print stop operations are requested during printing.

Figure 1:
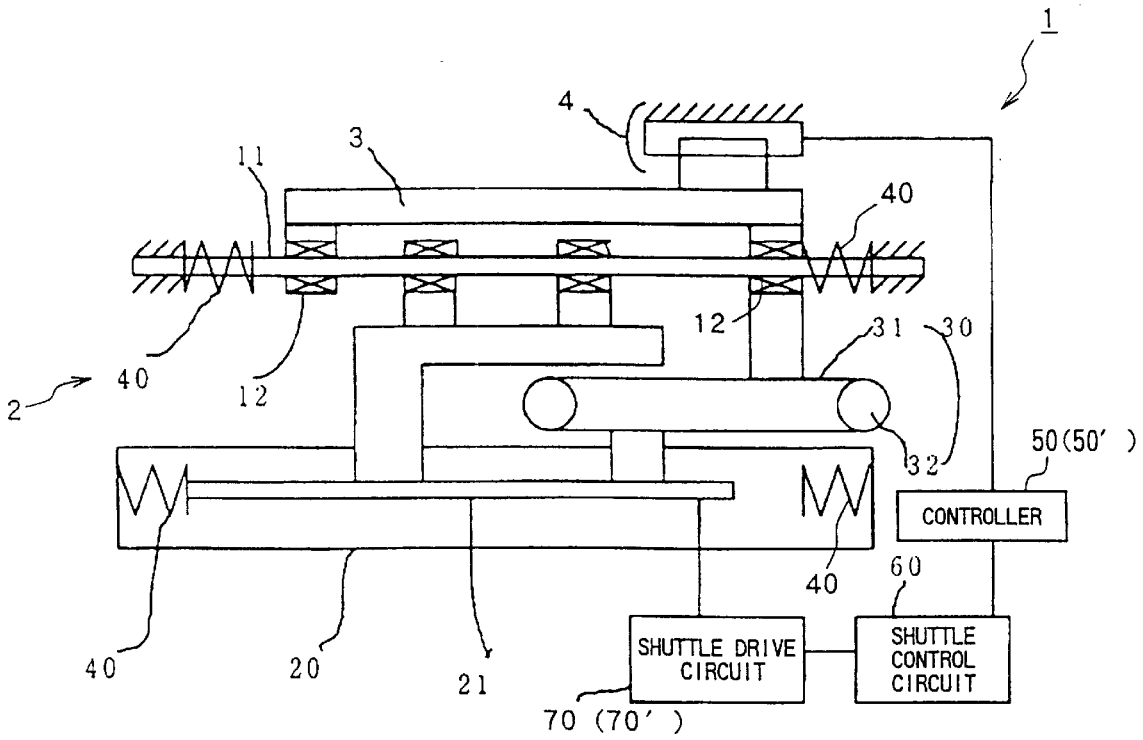
FIG. 1 is a schematic view of a print unit having a shuttle mechanism according to a conventional configuration and an embodiment of the present invention.
Figure 2:
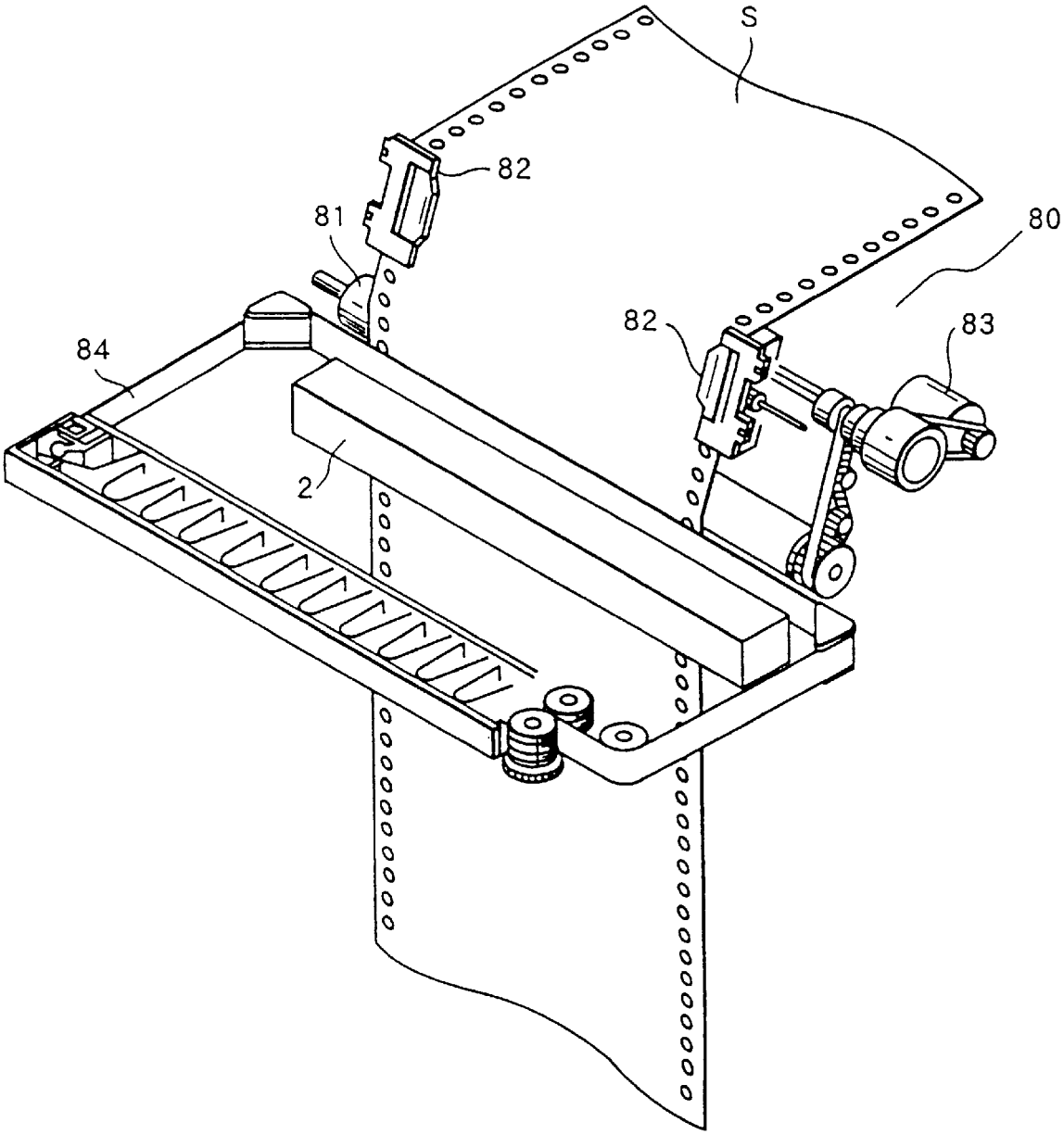
FIG. 2 is a perspective view showing a print unit according to a conventional configuration and the embodiment of the present invention.
Figure 3:
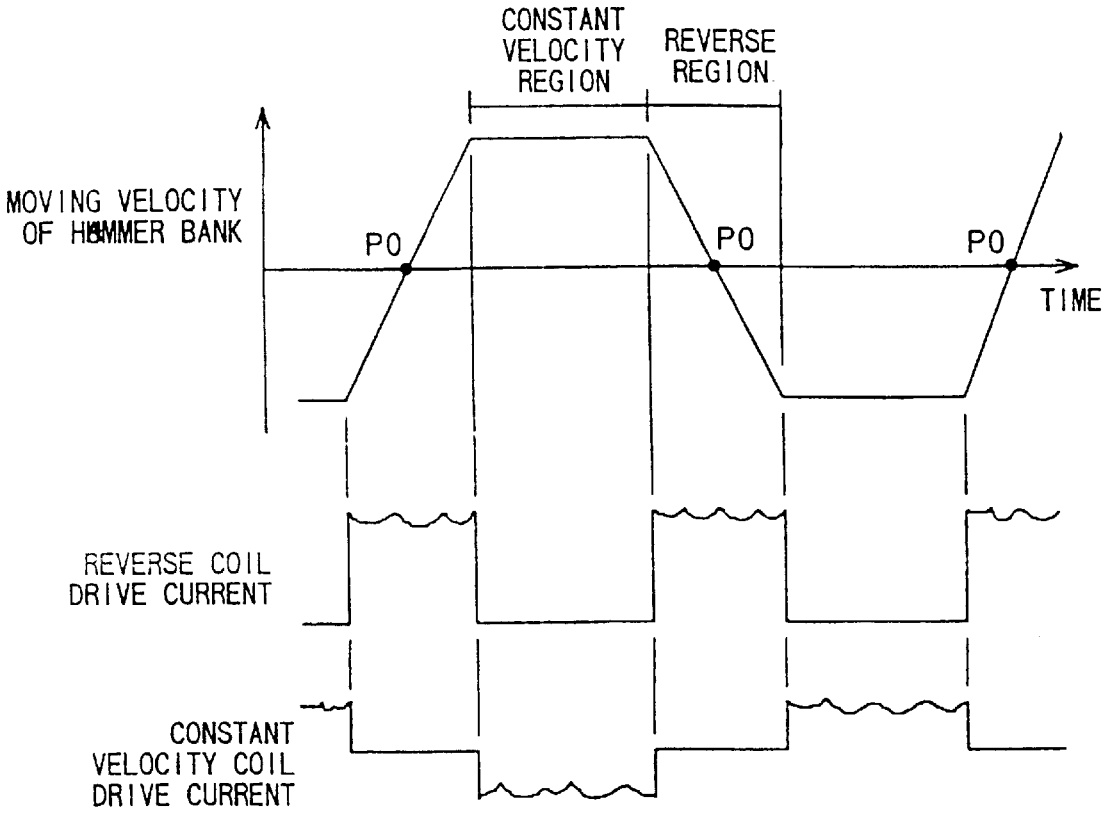
FIG. 3 PRIOR ART
FIG. 3 is a graph showing a relationship between a conventional shuttle speed and an electric current waveform.
Figure 4:
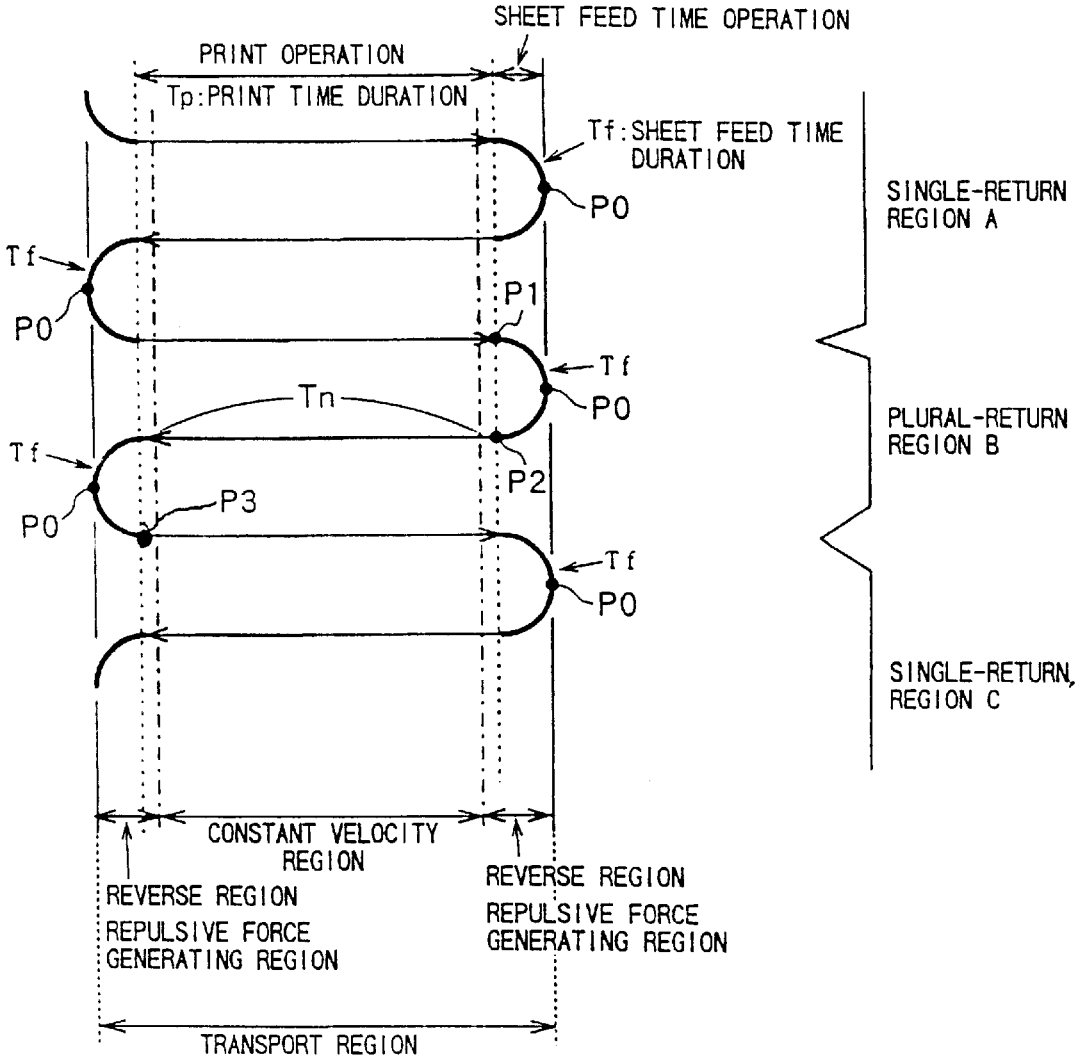
FIG. 4 PRIOR ART
FIG. 4 is a graphical representation of a conventional shuttle orbit.
Figure 5:
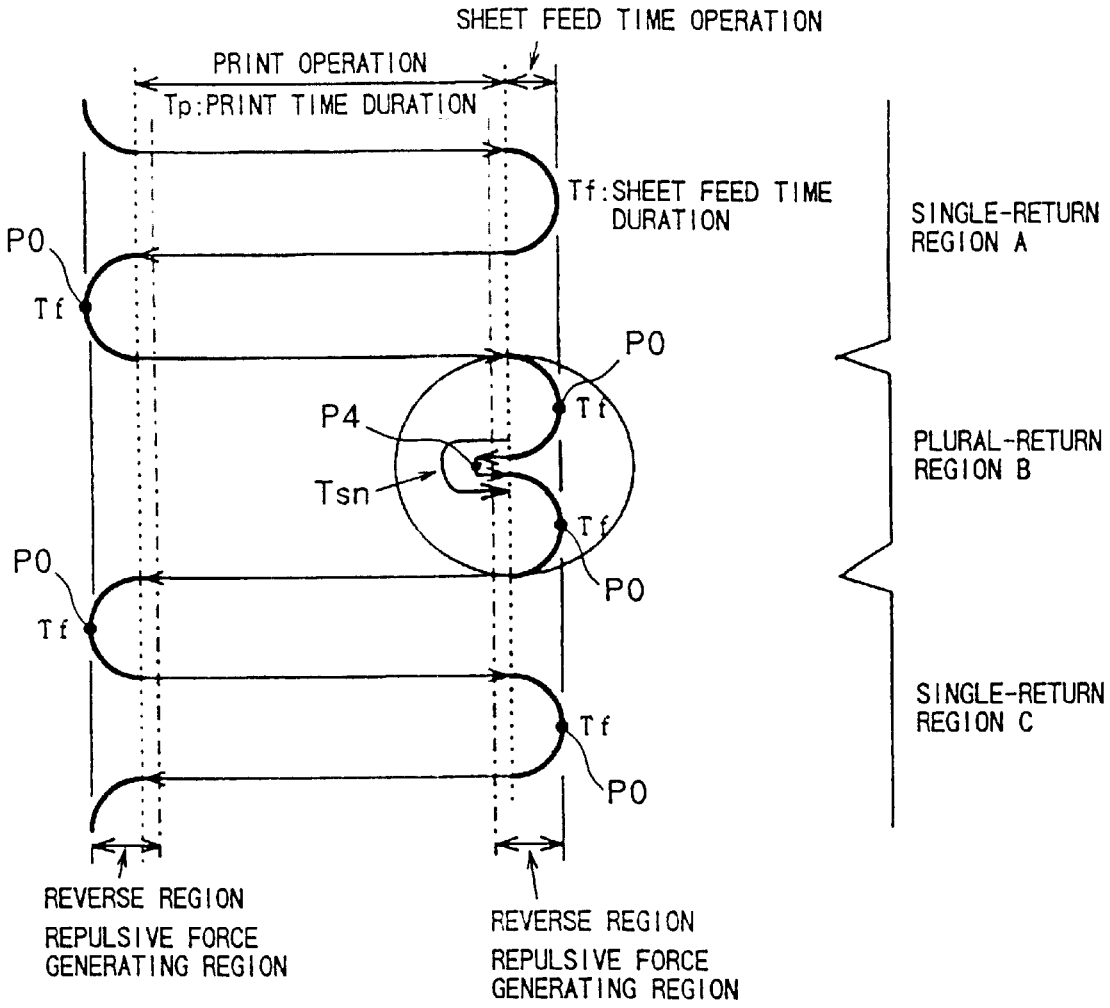
FIG. 5 is a graphical representation of a shuttle orbit according to the present invention.

FIG. 5 is a chart representing stop and restart of shuttle operations performed for a plurality of carriage returns. As shown in FIG. 5, sheet feed operations for a single carriage return are performed in single-return regions A and C, and sheet feed operations for a plurality of carriage returns are performed in a plural-return region B. The sheet feed operations for single carriage returns are performed in the same manner as in the conventional situation. However, for a plurality of carriage returns, after the shuttle direction is reversed at a reverse position P0, stopping operations are performed to stop the hammer bank 3 at a predetermined stop position P4 within the constant velocity region. Then, after a stopping time Tsn elapses, restart operations are performed to move the hammer bank 3 back to the reverse position P0 while compressing the spring 40 to its maximum compressing amount. Then, normal shuttle operations are started using the repulsive force of the spring 40. The stopping time Tsn is adjusted so that sheet feed time Tfn for a plurality of carriage returns is equal to single line sheet feed time Tf times two plus the stopping time Tsn (i.e., $Tfn=Tf\times2+Tsn$).

In this way, the shuttle reverse timing can be controlled to synchronize with completion of sheet feed operations. Further, because the shuttle operations are restarted by using the repulsive force of the spring 40, the predetermined shuttle speed can be achieved immediately after shuttle operations are restarted, thereby enabling immediate printing of a subsequent row of image. Therefore, amount of wasted time is less than in the conventional situation, and non printing time can be reduced to the minimum.

Figure 6:
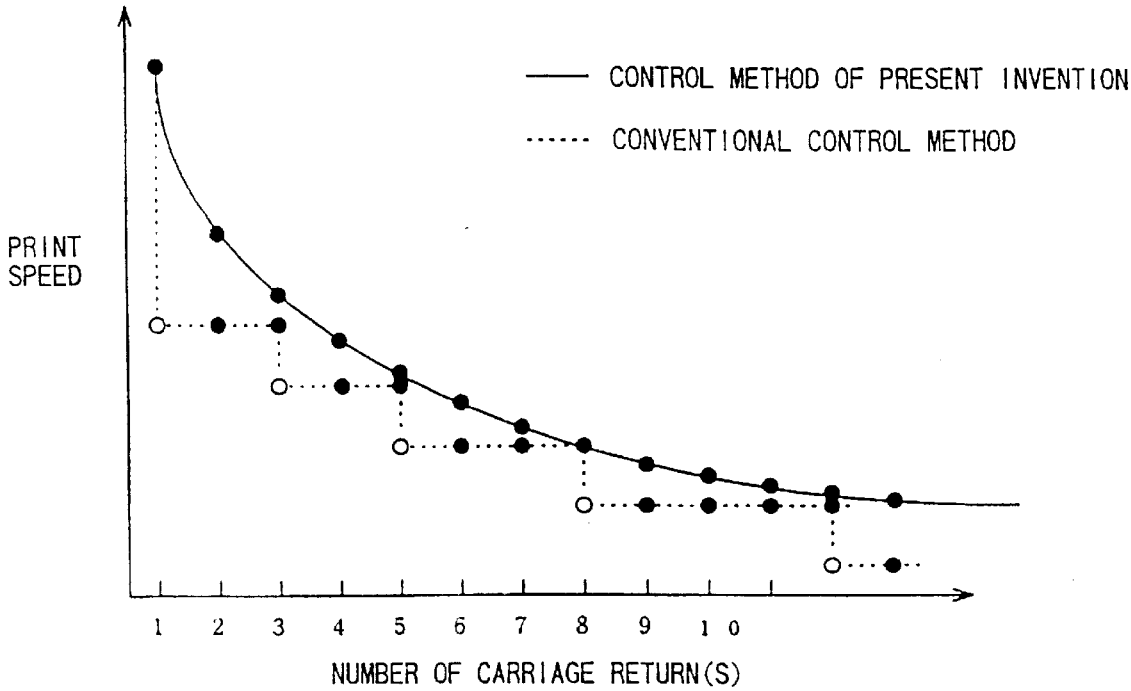
FIG. 6 is a graph showing a relationship between a carriage return amount and a printing speed in a conventional situation and according to the present invention.

FIG. 6 is a chart showing relationship between number of carriage returns and printing speed, for comprising the conventional situation and the situation of the present invention. The solid line in FIG. 6 indicates the case when printing is performed using a shuttle control method according to the present invention, and the dotted line represents the case wherein printing is performed using a conventional shuttle control method. As apparent from the chart in FIG. 6, the control method according to the present invention enables printing operations to be performed faster than the conventional control method.

Figure 7:
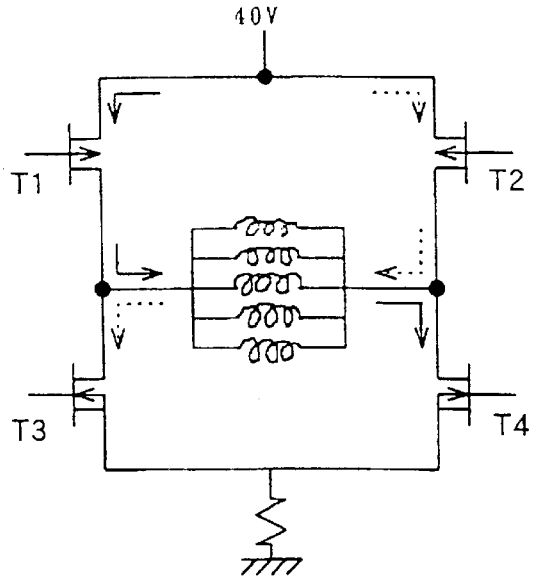
FIG. 7 is a circuit diagram representing a shuttle drive circuit and a reverse coil according to the present invention.

In order to perform the above-described stop and the restart operations, a driving force greater than the repulsive force of the spring 40 needs to be generated to compress the spring 40 to the reverse position P0. For generating such a driving force, the shuttle drive circuit 70' controls a direction of electric current flowing through the reverse coil. More specifically, as shown in FIG. 7, the shuttle drive circuit 70' includes transistors T1, T2, T3, T4, and, for example, a 40V power source. During the normal shuttle operation, that is, non associative with the stop and restart operations, the transistors T1 and T4 are turned ON, and the transistors T2, T3 are turned OFF, so that the electric current flows in a direction indicated by sold arrows in FIG. 7. On the other hand, during the stopping and restart operations, the transistors T1, T4 are turned OFF and the transistors T2, T3 are turned ON so that the electric current flows in a direction indicated by the dotted arrows in FIG. 7. Accordingly, during stopping and restart operations, a large driving force can be generated.

Figure 8:
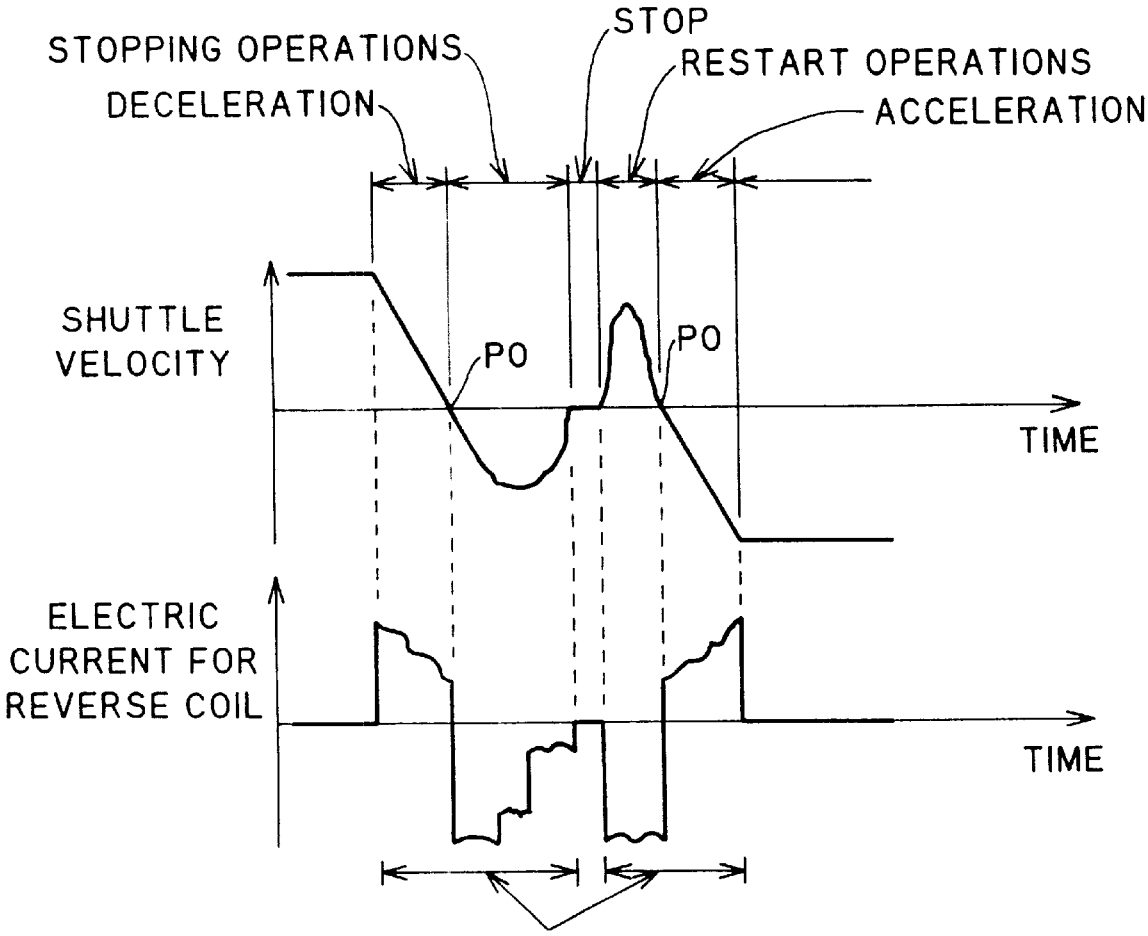
FIG. 8 is a graph showing shuttle speed and coil current waveform according to the present invention.

FIG. 8 shows a shuttle velocity and a waveform of the electric current supplied to the reverse coil. As described above, the repulsive force of the spring 40 indicates a maximum value when the hammer bank 3 compresses the spring 40 to the reverse position P0. Accordingly, in order to perform stopping operations, a maximum amount of electric current should be supplied first to the reverse coil so as to counter the repulsive force. Then, because the repulsive force of the spring 40 decreases as the hammer bank 3 is moved away from the reverse position P0, the shuttle control circuit 60 reduces the electric current amount step by step. In this way, the hammer bank 3 can be smoothly stopped at the stop position P4.

Further, immediately before the hammer bank 3 reaches the reverse position P0 at the restart operations, the shuttle is accelerated in the reverse direction. In this way, the hammer bank 3 is prevented from being transported over the reverse position P0.

Figure 9:
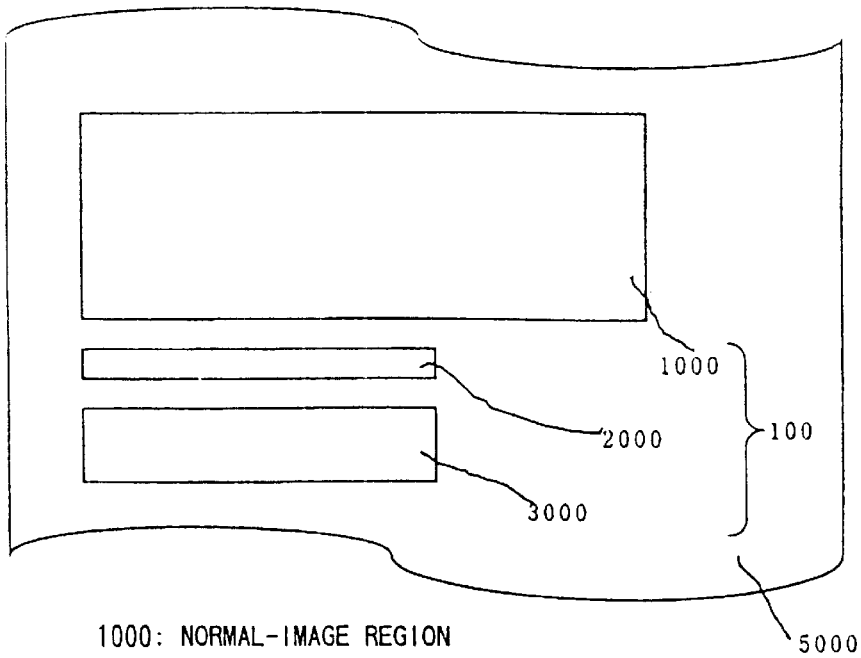
FIG. 9 is an example of a print pattern including special characters.

It should be noted that instead of step by step control, the control can be linear in proportion to the reverse repulsive force of spring 40 in order to achieve a greater effects. Further, because of the stopping and restart operations of the shuttle described above, printing modes can be easily changed even during printing, thereby improving printing speed. For example, a recording sheet 5000 in FIG. 9 is formed with a printing pattern 100. The printing pattern 100 includes a normal-image region 1000, an Optical-character-reader(OCR)-image region 2000, and a barcode-image region 3000. Normally, OCR images and barcode images in the OCR-image region 2000 and the barcode-image region 3000 need to be printed in a high quality print mode so that the printed images can be properly read by an optical reader mechanism. On the other hand, a normal image in the normal-image region 1000 can be printed in a comparatively low print quality with less dot density using a high speed print mode. However, in the conventional situation, all images of the printing pattern 100 needs to be printed using the high quality print mode because it is difficult to switch between different printing modes during printing. Because the high quality print mode requires more time than the high speed print mode, overall printing speed for printing the pattern 100 is slow.

However, according to the control method of the present invention, the printing modes can be easily switched even during printing operations. Therefore, the OCR image in the OCR-image region 2000 and the barcode image in the barcode-image region 3000 can be printed in the high quality print mode, and the normal image in the normal-image region 1000 can be printed in the high speed print mode. Accordingly, printing time can be reduced compared to when entire print pattern 100 is printed in the high quality print mode.

Figure 10:
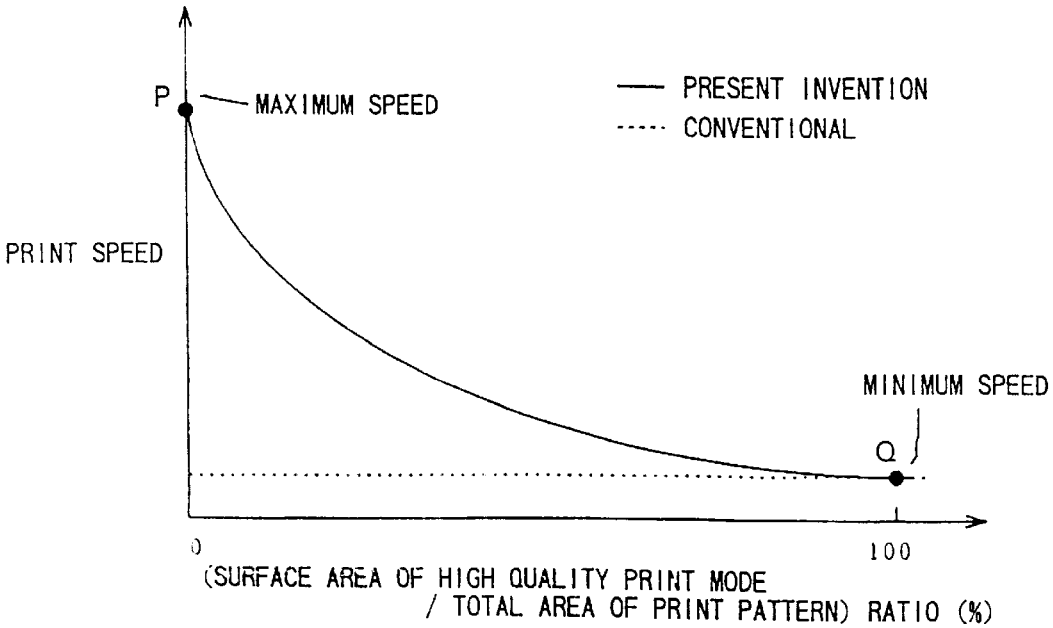
FIG. 10 is a graph showing a relationship between print speed and rate of various types of character regions according to a conventional situation and a present invention.

FIG. 10 shows a relationship between print speed and a surface area ratio. The surface area ratio is the ratio of surface area printed with a high quality image region, such as the OCR-image region and the barcode-image region, to overall surface area. The overall surface area includes the high quality image region and a low quality region, such as the normal-image region 1000. According to the conventional printing method, all of the regions are printed in the high quality print mode, so that the print speed remains at a constant low speed regardless of the ratio of the surface area ratio. On the other hand, according to the method of the present invention, the print speed increases with increase in the relative amount at the surface area of the low quality image region. That is, print speed improves depending on the surface area ratio between a minimum print speed Q, at which the print pattern is printed all in the high quality print mode, and a maximum print speed P, at which the print pattern is all printed in the high speed print mode.

Figure 11:
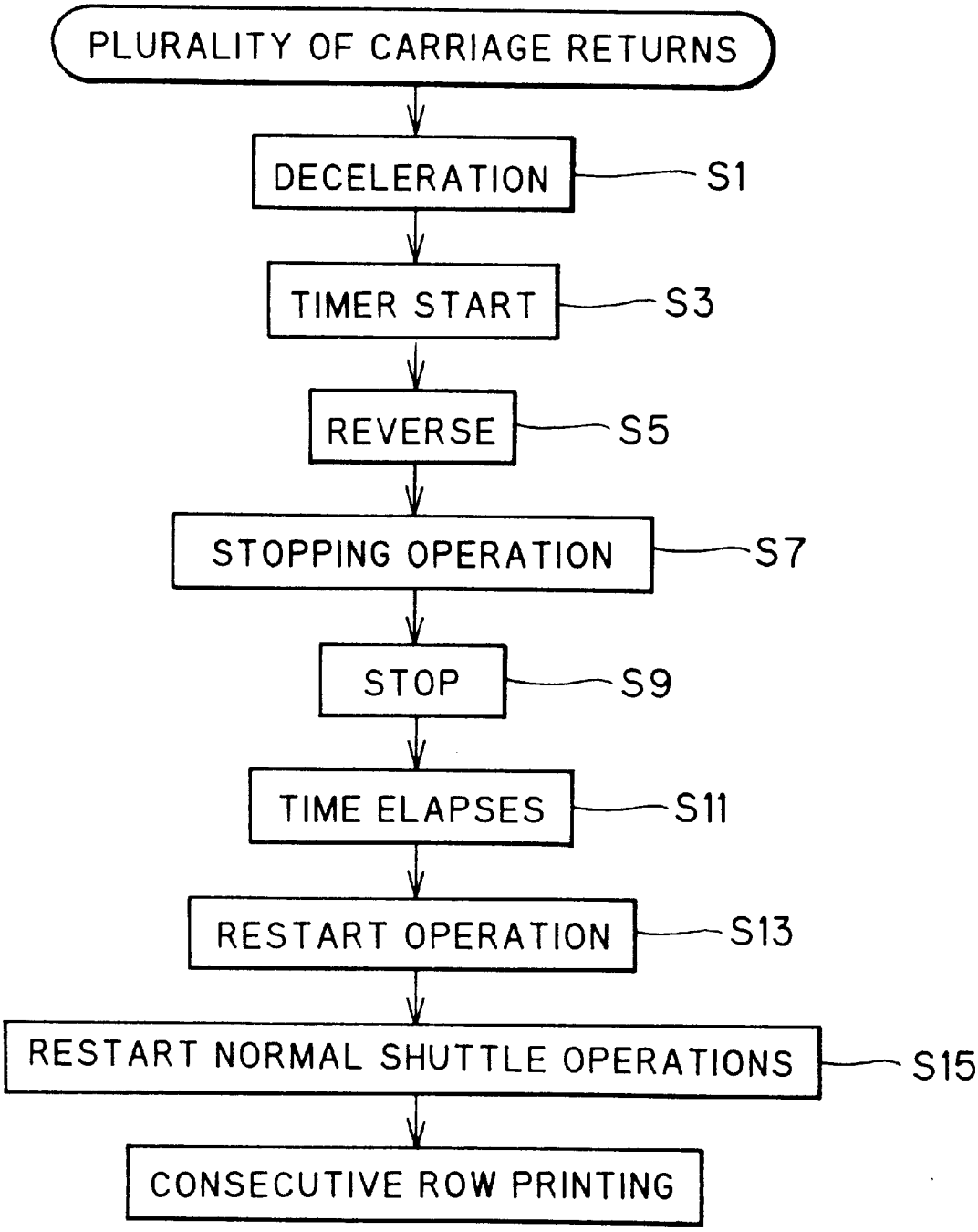
FIG. 11 is a flowchart representing operations according to the present invention for controlling a plurality of carriage returns.
Figure 12:
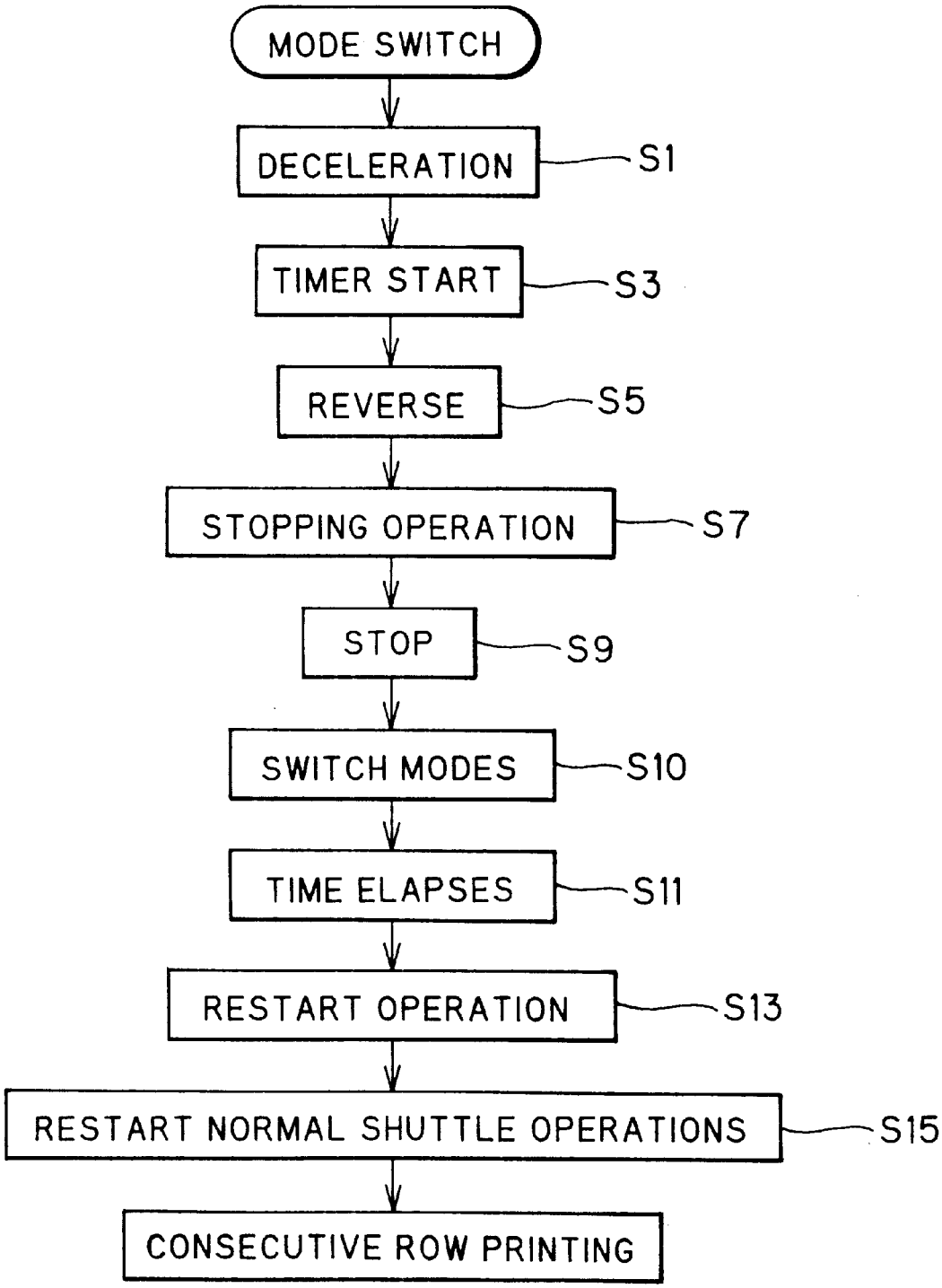
FIG. 12 is a flowchart representing operations for controlling mode switching according to the present invention.
Figure 13:
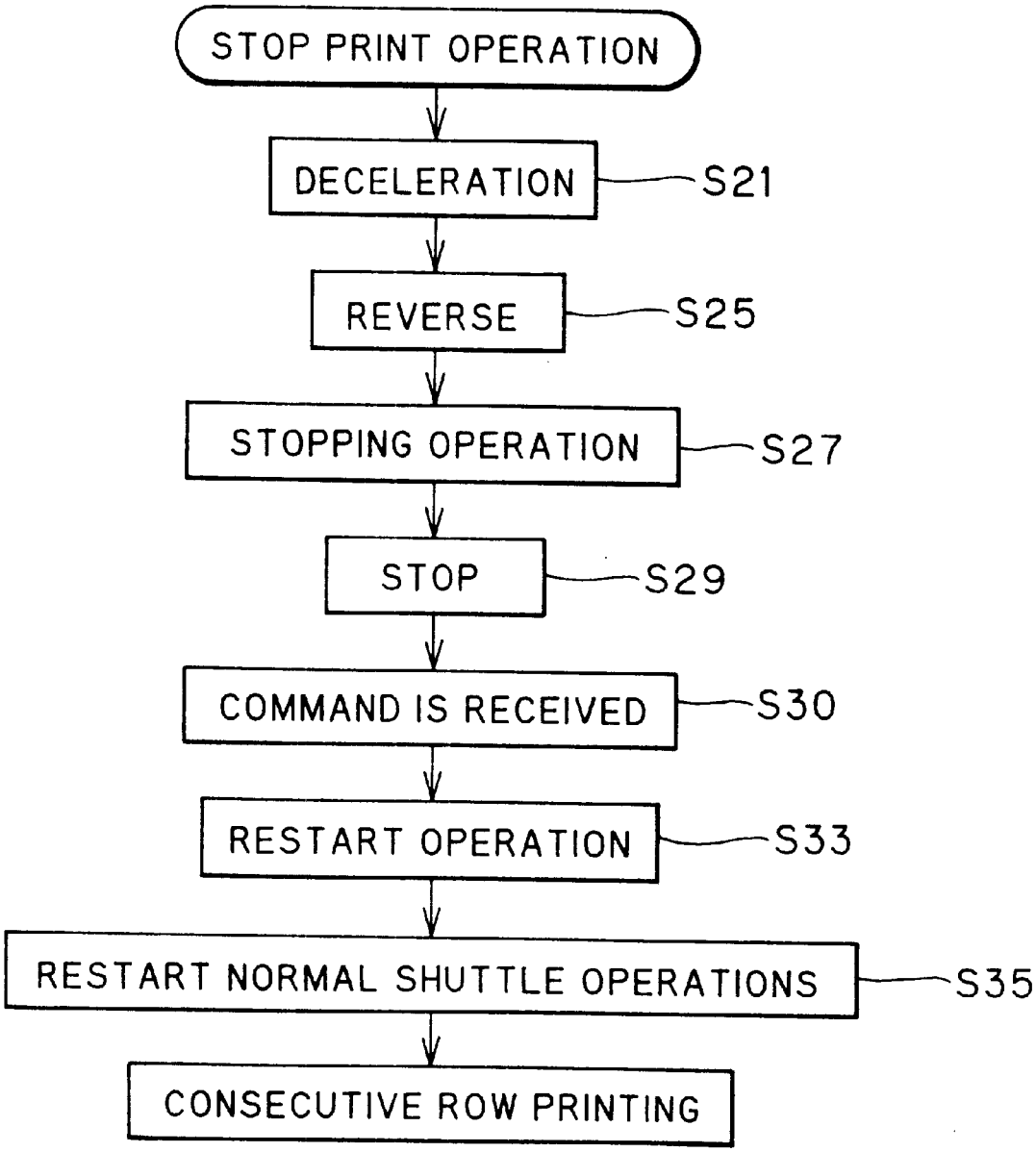
FIG. 13 is a flowchart representing operations for controlling stopping and restarting of the shuttle according to the present invention.

Next, a control method according to the present invention for stopping and restarting shuttle operations will be explained while referring to the flowcharts shown in FIGS. 11, 12, and 13. All of these controls are executed by the controller 50'.

First, plural-carriage-return control operations will be explained while referring to the flowchart shown in FIG. 11. The plural-carriage-return operations are started when a command for a plurality of carriage returns is received from an external host computer during operations for printing consecutive rows of images.

When the plural-carriage-return control operations are started, first in S1, deceleration control is started for decelerating the hammer bank 3 so as to reverse the shuttle direction at the reverse position P. Next in S3, the timer is started at a predetermined timing anytime between S1 and S5 to be described later. However, it is desirable to start the timer in synchronization with completion of printing at the timing P1. Then, the hammer bank 3 is reversed in S5 at the reverse position P0. The stopping operations are performed in S7, and the hammer bank 3 is stopped at the stop position P4 in S9.

When a predetermined duration of time elapses from when the timer is started in S3 (S11), then, in S13, the restart operations are performed. The hammer bank 3 is moved back to the reverse position P0, and the normal shuttle operations are restarted in S15. The program returns to consecutive row printing operations.

Next, mode-switching control operations will be explained while referring to the flowchart shown in FIG. 12. The mode-switching control operations are started when a command for switching printing modes is received from the host computer.

The mode-switching control operations are substantially the same as the plural-carriage-return control operation described above with the exception that a mode switching process is performed in S10 between S9 and S11. Here, the predetermined time measured by the timer is a fixed time required for executing the mode switching process.

Next, print-stopping operations will be explained while referring to the flowchart in FIG. 13. The print-stopping operations are started when a command indicating to stop printing is received from the host computer during consecutive row printing operations.

When the print-stopping operations are started, deceleration is performed in S21 to decelerate the shuttle speed. When the direction of shuttle movement is reversed in S25, then stopping operations are performed in S27 and the hammer bank 3 is stopped at the stop position P4 in S29. When a command indicating to restart printing is received in S30 from the host computer, the restart operation is performed in S33, and the normal shuttle operations is restarted in S35. Then, the program returns to the consecutive row printing.

As described above, according to the present invention, the shuttle operations can be instantaneously stopped and restarted in synchronization with completion of sheet feed operations. Therefore, operation efficiency can be greatly improved in printing associated with a plurality of carriage returns.

Further, printing modes can be quickly switched while shuttle operations are temporality stopped. Therefore, operation efficiency is improved even during printing not-associated with a plurality of carriage returns.

Moreover, because initialization operations are unnecessary, printing can be started immediately after the print devices are turned ON.

While the invention has been described in detail with reference to specific embodiments thereof, it would be apparent to those skilled in the art that various changes and modifications may be made therein without departing from the spirit of the invention, the scope of which is defined by the attached claims.

For example, in the embodiment described above, the reciprocal movements of the hammer bank 3 and the coil 21 which serves as the counter balance, are both driven by the linear motor 20. However, reciprocal movements of the hammer bank 3 and the coil 21 can be driven by separate linear motors.

Also, the spring 40 applies the repulsive force to the hammer bank 3 in the above-described embodiment. However, any resilient member having sufficient resiliency can be used instead of the spring 40. Alternatively, a magnet, such as an electric magnet, can be used. In this case, repulsive force is generated when the same magnetic poles are brought into confrontation with each other.

Figure 14:
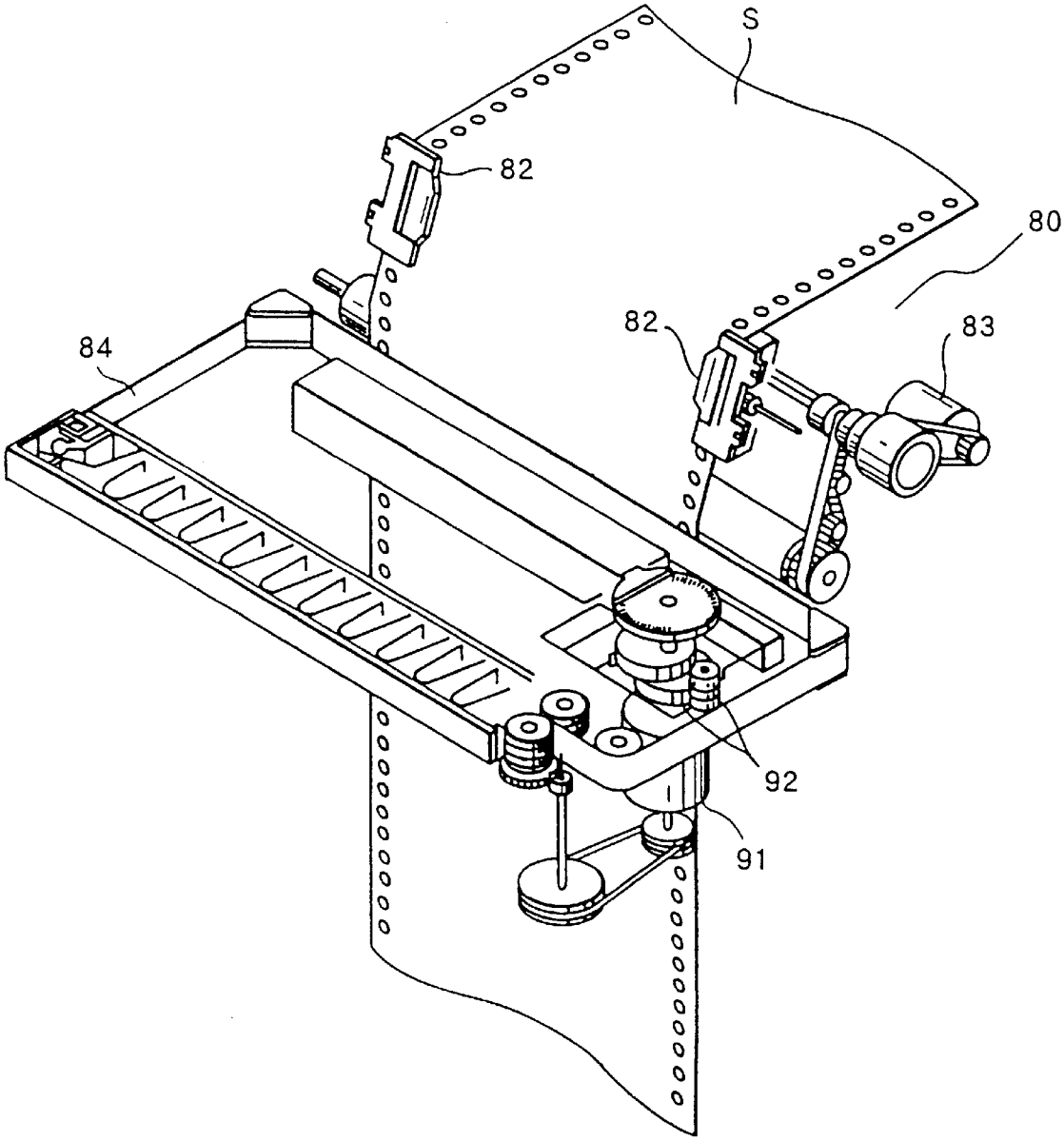
FIG. 14 is a perspective view showing a print unit according to a modified embodiment of the present invention.
Figure 15:
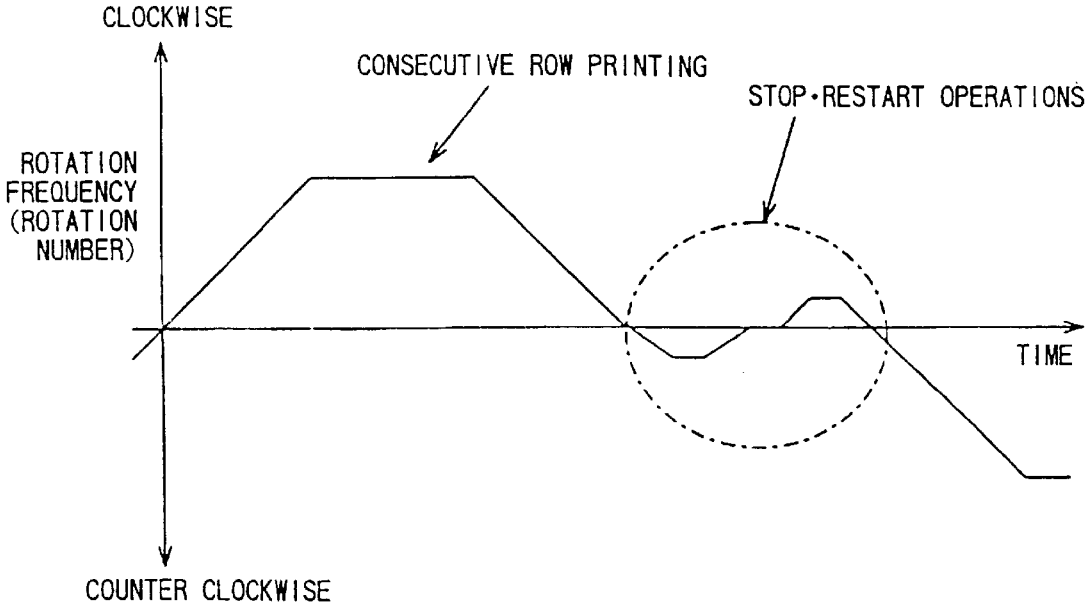
FIG. 15 is a graph showing motor speed curve of a rotational motor according to the present invention.

Further, instead of the linear motor 20, as shown in FIG. 14, a rotating motor, such as stepping (pulse) motor or a direct current motor, shown in FIG. 14 can be used. In FIG. 14, driving force from a rotating motor 91 is transmitted to a cam 92, and further to the hammer bank 3, thereby reciprocating the hammer bank 3. In this case, rotation frequency (rotation number) of the rotating motor during printing is controlled in a manner graphically shown FIG. 15, thereby achieving the same shuttle drive control as the above-described embodiment.

What is claimed is:

1. A control method of controlling an image forming device, the image forming device includes a shaft extending in a longitudinal direction, an image forming unit that is reciprocally movable along the shaft within a moving region defined by two extremes where the image forming unit reverses, the moving region including a first region, a second region, and a third region between the first region and the second region, a driving mechanism that reciprocally moves the image forming unit and urging means provided in each of the first region and the second region for urging the image forming unit toward a center of the shaft when the image forming unit is in the first region or the second region, wherein the image forming unit is brought into contact with the urging means when moved into the first region or the second region from the third region, the control method comprising the steps of:

a) stopping the image forming unit at a predetermined position within the third region; and b) resuming reciprocal movement of the image forming unit by a driving force greater than a repulsive force of the urging means to one of the two extremes closer to the predetermined position.

2. The control method according to claim 1, further comprising the step of accelerating the reciprocal movement of the image forming unit to reach a predetermined speed when the image forming unit first enters the third region by virtue of the urging force of the urging means.

3. The control method according to claim 1, wherein step a) is executed when a command is received from an external device, the command indicating to feed a recording medium by more than a predetermined amount at one time.

4. The control method according to claim 1, wherein step a) is executed when a command is received from an external device, the command indicating to change a speed pattern of the reciprocal movement of the image forming unit.

5. The control method according to claim 4, further comprising the step of c) transporting the image forming unit to the one of the two extremes, d)reversing a moving direction of the image forming unit at the one of the two extremes, and e) transporting the image forming unit to the predetermined position, wherein steps c), d) and e) are performed before step a).

6. The control method according to claim 5, further comprising the step of f) repeating reciprocal movement of the image forming unit by supplying electric current to a linear motor, the electric current flowing in a first direction in the step f), the electric current flowing in a second direction opposite from the first direction in step e).

7. The control method according to claim 6, wherein an amount of the electric current supplied to the driving mechanism is decreased in a stepwise manner in step e).

8. The control method according to claim 7, wherein a direction in which the electric current is supplied to the linear motor in step c) is changed from the second direction to the first direction immediately before step d).

9. The control method according to claim 1, further comprising the step of g) repeating reciprocal movement of the image forming unit continuously after the step b), wherein the driving mechanism moves the image in the step g), the electric current flowing in a second direction opposite from a first direction when the image forming unit is moved to the one of the two extremes in step b).

10. The control method according to claim 5, further comprising the step of compressing the urging means prior to the reversing step of d).

11. The control method according to claim 5, further comprising the step of decreasing a speed of the image forming unit prior to the transporting of the image forming unit to the predetermined position of step e).

12. The control method according to claim 1, further comprising the step of decreasing a speed of the image forming unit prior to stopping the image forming unit at the predetermined position of step a).

13. The control method according to claim 6, further comprising the step of maintaining the electric current to the linear motor in the first direction in order to compress the urging means in either of the first region or the second region.

14. The control method according to claim 9, further comprising the step of maintaining the electric current to a linear motor in the first direction in order to compress the urging means in either of the first region or the second region.

15. A control method of controlling an image forming device including the steps of:

moving an image forming unit in a reciprocal movement along a shaft within a first reversing region, a second reversing region and a constant velocity region positioned between the first reversing region and the second reversing region;

stopping the image forming unit at a predetermined position within the constant velocity region when a command is executed from a device to feed a recording medium by more than a predetermined amount at one time or to change a speed pattern of reciprocal movement of the image forming unit; and resuming the reciprocal movement of the image forming unit in the third region to a closer of the first reversing region or the second reversing region by a driving force greater than a compressive force of an urging means positioned in the first reversing region and the second reversing region.

16. The control method according to claim 15, further comprising the step of controlling an electric current in a first direction or a second direction in a reverse coil for driving the image forming unit in either a first direction or a second direction, respectively.

17. The control method according to claim 16, further comprising the step of providing the electric current to the reverse coil in the first direction so that the image forming unit overcomes the compressive force of the urging means.

18. The control method according to claim 15, further comprising the step of controlling the electric current in the second direction so that the image forming unit can gradually come to a stop in the predetermined position in the constant velocity region.

* * * * *